US005613894A

United States Patent [19]

Delle Vedove

[11] Patent Number: 5,613,894

[45] Date of Patent: Mar. 25, 1997

[54] METHOD TO HONE CURVED AND SHAPED PROFILES AND HONING MACHINE TO CARRY OUT SUCH METHOD

[75] Inventor: Gaetano Delle Vedove, Pordenone, Italy

[73] Assignee: Delle Vedove Levigatrici SpA, Italy

[21] Appl. No.: 358,943

[22] Filed: Dec. 19, 1994

[30] Foreign Application Priority Data

Dec. 30, 1993 [IT] Italy ..... UD93A0269

[51] Int. Cl.[6] ..... B24B 49/00

[52] U.S. Cl. ..... 451/1; 451/6; 451/21; 451/44; 451/281

[58] Field of Search ..... 451/5, 6, 8, 9, 451/10, 11, 21, 62, 464, 465, 121–124, 237, 239, 43–44, 14, 23, 281, 142, 408

[56] References Cited

U.S. PATENT DOCUMENTS

| | | | |
|---|---|---|---|
| 3,928,945 | 12/1975 | Devillers . | |
| 4,525,958 | 7/1985 | Reissig . | |
| 4,528,780 | 7/1985 | Halberschmidt et al. . | |
| 4,578,764 | 5/1986 | Leone et al. | 451/44 |
| 4,638,601 | 1/1987 | Steere et al. | 451/44 |
| 4,658,550 | 4/1987 | Meyers et al. | 451/6 |
| 4,833,833 | 5/1989 | Rhodes . | |
| 5,077,941 | 4/1992 | Whitney | 451/6 |
| 5,216,844 | 6/1993 | Tamburini et al. | 451/21 |
| 5,367,834 | 11/1994 | Delventhal | 451/281 |
| 5,458,527 | 10/1995 | Kondo et al. | 451/21 |

FOREIGN PATENT DOCUMENTS

| | | |
|---|---|---|
| 0293341 | 11/1988 | European Pat. Off. . |
| 0533505 | 3/1993 | European Pat. Off. . |
| 4108391 | 9/1992 | Germany . |

*Primary Examiner*—Robert A. Rose
*Assistant Examiner*—George Nguyen
*Attorney, Agent, or Firm*—Breiner & Breiner

[57] ABSTRACT

Method to hone curved and shaped profiles which belong to furniture elements, which are advantageously of furniture of an antique style, such as surfaces of tables, mouldings of furniture or pictures, panels, doors of kitchen cupboards, seat elements, etc., the profile to be honed of which includes at least one shaping with projections (35) and valleys (34) positioned close together, the method including a step of continuous identification and reading of each position of the profile of the specific piece (11) to be honed by means of a profile-reader assembly (17), a step for storage of the data relating to that profile/position, and a step of transfer of such data to an operating unit (18) equipped with a relative operating element (32) that performs the honing with a resulting governing of the position of that operating unit (18) in relation to the piece (11) to be honed, this step of transfer of the data taking place with a delay after the step of identification and reading, this delay being a function of the circumferential position of the operating unit (18) in relation to the profile-reader assembly (17) and being a function of the relative speed of feed of the piece (11) to be honed in relation to operating element (32), the method including also steps of automatic compensation of the wear of the operating element (32) and steps of compensation of the intensity of the honing action of the operating unit (18), these compensation steps depending on the geometric and structural characteristics of the profile of the piece (11) to be honed, on the characteristics of the operating element (32) and on the type of processing performed. Honing machine which performs the above method.

27 Claims, 4 Drawing Sheets

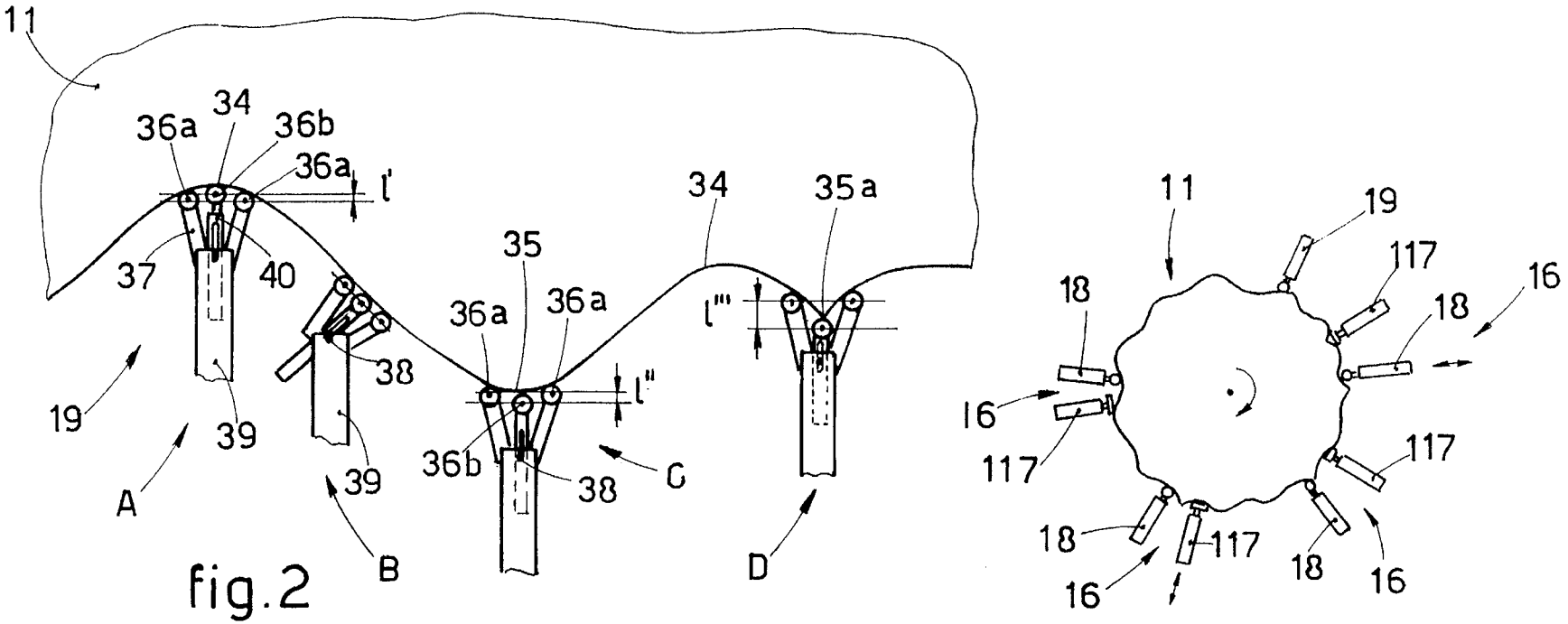
fig.2
fig.3
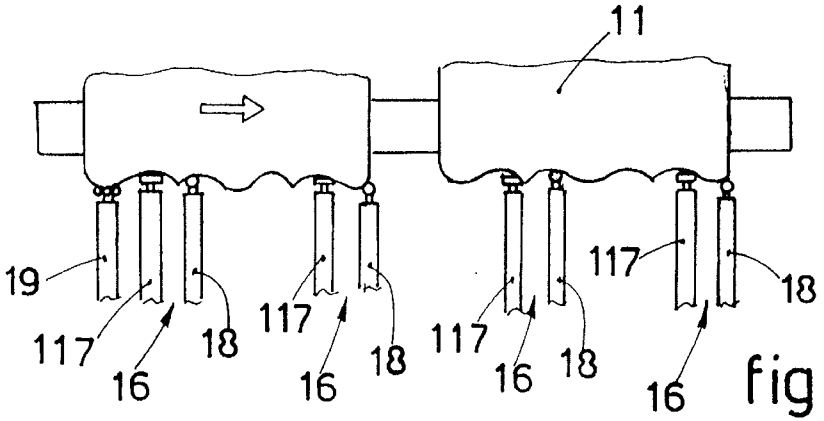
fig.4

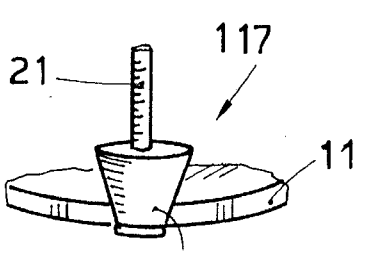
fig.5a
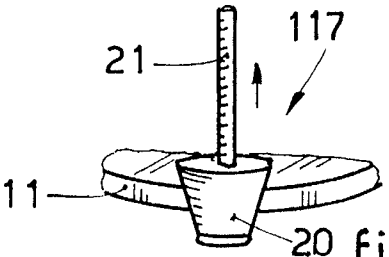
fig. 5b
fig.5c
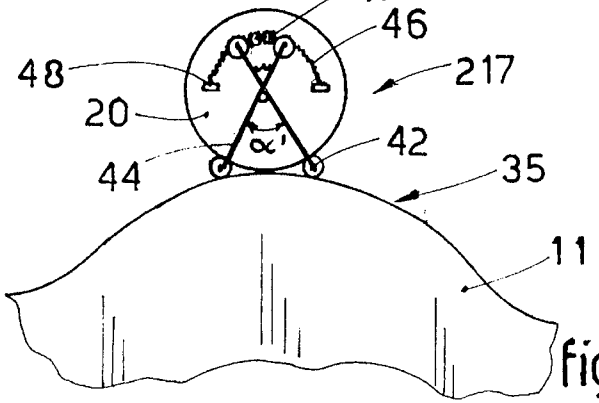
fig.7a
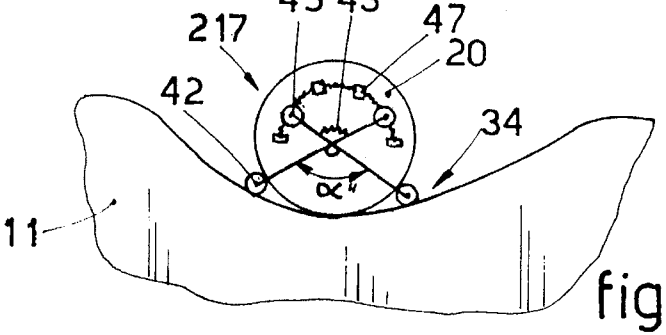
fig.7b
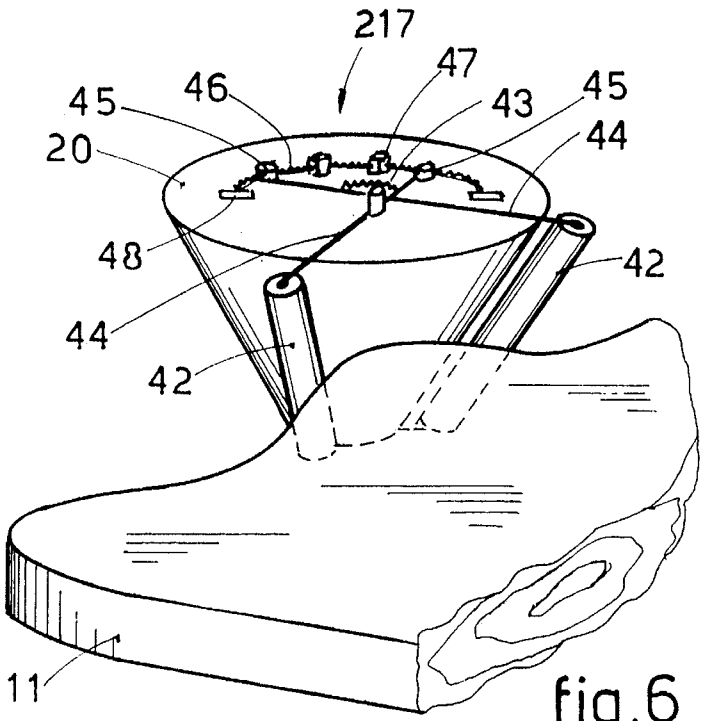
fig.6

METHOD TO HONE CURVED AND SHAPED PROFILES AND HONING MACHINE TO CARRY OUT SUCH METHOD

This invention concerns a method to hone curved and shaped profiles and also the honing machine to carry out such method, as set forth in the relative main claims.

To be more exact, the method and honing machine according to the invention are suitable to perform honing operations on profiles which are at least partly curved or shaped and which belong advantageously to furniture elements.

This invention is applied in particular, but not only, to the honing of surfaces of tables, mouldings of furniture or pictures, panels, doors of kitchen cupboards, elements of chairs, etc.

This invention is also especially indicated for the honing of furniture elements leaving the varnishing shop but can be applied also to furniture elements in the raw state without varnish.

The automatic honing machines of the state of the art consist typically of a conveyor surface, on which the piece being processed is fed substantially in a straight line, and of a plurality of processing heads which act in sequence on the piece being fed.

These processing heads generally comprise grinding wheels or abrasive belts, or combinations of wheels and belts, normally installed in succession in a manner coordinated with the surface to be honed.

The position of the processing heads in the honing machines of the state of the art is substantially not changed in relation to the piece being fed.

The type of the processing heads depends on their position on the honing machine as well as on the type, material and profile of the piece being processed.

The first processing heads generally carry out roughs-haping of the piece, whereas the successive processing heads perform the real honing and the last processing heads are equipped for providing a high-quality finish to the piece to be processed.

The most developed honing machines include devices for the automatic take-up of the wear of the grinding wheels, for this wear is especially important, particularly so in the case of the grinding wheels providing the final finish.

These devices for take-up of the wear obtain a progressive approach of the grinding wheel in the axial direction so as to compensate the reduction of diameter of that wheel as a result of wear and thus to keep the working pressure substantially constant.

The state of the art does not include specific efficient honing machines to process furniture elements or other products that have an at least partly curved, moulded or variously shaped profile.

The embodiment of such honing machines has always entailed a series of problems linked to the need to ensure an efficient, uniform and constant action of the processing heads on the piece to be honed; other problems have so far prevented the development and embodiment of such a type of honing machine.

Such problems mainly concern the correct and constant positioning of the processing head in relation to the piece to be honed, the compensation of the wear of the abrasive elements, the evenness of the honing action of the processing head at the various points of the shaped profile and yet other problems.

For some time now embodiments of honing machines have been tried for curved and shaped profiles whereby the movement of the processing heads has been performed according to a pre-set program which tends to re-produce the profile of the piece to be honed, but the results have not been found satisfactory owing to the low reliability and accuracy of the results.

Embodiments have also been disclosed in which grinding and/or lapping devices include at least one feeler means suitable to read the profile of the piece to be processed, or of a template having the same profile as the piece and to condition the means that actuate the honing tool according to that reading.

For instance, EP-A-0084506 discloses a device suitable in particular to grind the edges of glass sheets or surfaces. This device comprises a feeler means, which is positioned on an arm able to move linearly and is suitable to read the profile of the piece to be ground and to convert that reading into an electrical signal that conditions the drive motor of the grinding tool; this drive motor acts with a pre-set period of delay, which depends on the angle defined by the working axes respectively of the feeler means and of the tool in relation to the piece to be ground and on the relative speed as between the tool and the piece.

This device, however, is not suitable to process pieces having an especially irregular profile characterised by the presence of a plurality of projections and valleys succeeding each other, particularly when such projections and valleys are characterised by extremely small radii of curvature, such as the surfaces of antique-type furniture, for instance.

This device, moreover, does not include means for the automatic compensation of the wear of the tool working on the piece, nor does it include means to regulate the speed of rotation and/or the pressure exerted by the tool on the piece according to the characteristics of the profile.

Furthermore, it does not arrange to compensate the intensity of the action of the tool according to its position in relation to the centre of rotation of the piece and therefore according to the relative peripheral speed as between the tool and the piece.

JP-A-60-29274 discloses a device for the grinding of products which includes a feeler means running on the profile of a template corresponding to the profile to be ground, thus inducing mechanically a corresponding movement of a grinding tool associated with the edges of the product.

This feeler means has a truncated-cone conformation and its surface in contact with the profile of the template can be varied to compensate the wear of the grinding tool.

This device is conceptually, structurally and operationally different from, and unsuitable as compared to, a device performing reading and direct identification of the profile of the piece to be processed, conversion of that reading into an electrical signal and conditioning of the means that actuates the working tool.

Furthermore, the association between the feeler means and the working tool being of a mechanical type, the variation of the vertical position of the feeler means so as to compensate the wear entails a lateral variation of position of the working axis of the tool in relation to the product being processed.

This entails frequent interruptions to re-position the tool and/or product correctly according to such displacements.

U.S. Pat. No. 4,525,958 too discloses a grinding device which includes a feeler means that follows the profile of a template and is associated mechanically with a tool acting on the profile of the piece to be processed.

This device too entails the same drawbacks as those mentioned with regard to JP-A-60-29274. Moreover, this device has the purpose of controlling the peripheral speed but not the reciprocal positions.

The failure to develop functionally efficient honing machines for the specific processing of curved and continuously steeply shaped profiles makes necessary at the present time the performance of such operations by hand with resulting high costs as regards execution times and use of labour, and these costs have an unfavourable effect on the end cost of the finished product.

The present applicants, in view of the requests made repeatedly over a long time by operators in this field, began some time ago to design, test and embody a machine suitable to hone furniture elements including an at least partly curved or shaped profile comprising projections and valleys close to each other.

The present invention is the outcome of such design work, testing and embodiment which have been in progress for a long time.

This invention is set forth and characterised in the respective main claims, while the dependent claims describe variants of the idea of the main embodiment.

The purpose of the invention is to provide a honing machine suitable to hone furniture elements such as mouldings, cupboard doors, surfaces of tables, etc., which have a curved or variously shaped profile.

This invention is especially suitable to hone pieces the profiles of which include a plurality of projections and valleys, which succeed each other continuously, particularly when characterised by small radii of curvature, such as in particular the surfaces of antique-type furniture.

The invention comprises means to displace the furniture element to be honed, such means being suitable to bring the whole profile of the furniture element progressively into cooperation with the processing assembly or assemblies with which the honing machine is equipped.

In a first embodiment of the invention, which is especially suitable for the processing of the surfaces of tables, the displacement means are of a turntable type and consist, for instance, of a rotary table. This turntable cooperates with means that keep the furniture element in position during the processing.

The means to keep the furniture element in position consist, in a first embodiment, of thrust means that act on the furniture element from above.

According to a variant the turntable includes aspiration means, which are set to work after the positioning of the furniture element and create a negative pressure that acts on the furniture element during the processing.

Where the displacement means are of a turntable type, the processing assemblies are fitted to shafts which can be moved advantageously in a radial direction in relation to the axis of rotation of the turntable.

According to a variant of the invention the displacement means are of a linear type and the processing assemblies are arranged at the side of the axis of feed of the furniture element being processed.

According to the invention a processing assembly comprises at least one assembly to read the profile, at least one operating unit and one governing and control unit.

The profile-reader assembly may be one single assembly for all the operating elements of the honing machine or one profile-reader assembly may be included for each of the operating units.

In a first embodiment of the invention the profile-reader assembly is of a type carrying out mechanical reading and including a feeler unit comprising at least one feeler element.

According to a variant the profile-reader assembly is of a type performing optical reading and comprises, for instance, an ordered series of photoelectric cells or laser sensors, or else one or more telecameras, or else a series of scanners or other like devices performing optical reading.

With reference to the direction of feed of the piece being processed, whether the direction be substantially circular or substantially linear, the profile-reader assembly is positioned advantageously upstream of the relative operating unit at a determined reciprocal position.

According to the invention each operating unit comprises an operating element which can move in relation to the piece to be honed. This operating element may consist, depending on the case in question, of a grinding wheel, an abrasive belt fitted to rollers, an abrasive belt fitted to rollers and cooperating with a thrust pad in the vicinity of the zone of contact, or another means suitable for the purpose.

The operating unit is governed advantageously by control means able to cause the operating element to carry out inversions of direction in approaching and departing from the piece in very short times.

The operating element includes abrasive means driven by a motor, the speed of which can be adjusted and advantageously be controlled electronically.

According to a variant the pressure too of the abrasive means against the piece to be honed can be adjusted and advantageously controlled electronically.

The honing method according to the invention provides for a step of identification and reading, performed by the profile-reader assembly, of every position of the profile of the piece to be honed together with storage and transfer of the relative data to the governing and control unit.

The governing and control unit conditions actuation of the operating unit with a period of delay which is a function of the distance by which the profile-reader assembly and relative operating unit are separated, and also of the relative speed of feed of the piece.

Where a plurality of operating units are governed by one single profile-reader assembly, the governing and control unit conditions the actuation of each operating unit with a relative distinct delay time, which is a function of the distance between the profile-reader assembly and the single operating unit and also of the relative speed of feed of the piece.

In this way the honing machine according to the invention achieves a continuous survey, performed directly on the piece itself, of the data relating to the profile of the piece to be honed and also the transfer of such data to the tool or operating element which has to work on that profile, with a resulting governing of the position of the operating element in relation to that profile.

Thus a constant, accurate and correctly timed positioning of the operating element is ensured, and the operating element can thus follow any type of curve, union, hollow or shaping on the profile.

The feeler element of the feeler unit is a means able to move in relation to the piece to be honed; this feeler element during processing is brought into contact with the periphery of the profile of the piece to be honed.

The displacements of the feeler element induced by the piece to be honed are stored by the governing and control unit, which thus determines in each case the actual profile of the piece and conditions in that way the actuation of the means that displace the operating element.

According to the invention the honing machine includes means suitable to carry out steps of automatic compensation of the wear of the operating element, especially of the grinding wheel, for such wear determines a reduction of the diameter of the operating element itself.

In a first embodiment of the invention these steps of automatic compensation of the wear are obtained by employing a special conformation of the feeler element.

An advantageous conformation of the feeler element, which is suitable to obtain compensation of the wear, is substantially a tapered or a truncated-cone conformation with its axis parallel to the nominal plane of the zone to be honed on the piece to be honed.

According to this embodiment the zone of contact of the feeler element with the profile of the piece to be honed is progressively varied according to the progressive reduction of diameter of the operating element.

At the start-up of processing the feeler element is brought into contact with the profile at a dimension thereof correlated with the dimension of the operating element.

As processing proceeds, the axial position of the feeler element is altered continuously or periodically at pre-set intervals so as to bring progressively into contact with the profile of the piece to be honed a surface of a gradually smaller diameter consistent with the reduction of the diameter of the operating element.

Compensation of the wear of the operating element enables the performance of the honing machine in terms of a constant and uniform action to be improved.

The frequency and amount of the dimensional variation of the feeler element can be optimised by equipping the governing and control unit with data banks relating to the quantification of the wear of the operating element in relation to its type and to the type of the piece to be honed, to the type of processing carried out, etc.

According to a variant the governing and control unit is associated with means to monitor directly the wear of the operating element, such means conditioning a continuous or periodical corrective action of the governing and control unit to determine a variation of the surface of contact of the feeler element, such variation being consistent with the monitoring of the wear on the operating element.

According to another variant the compensation of the wear on the operating element is achieved according to a fully automated procedure, starting from the data of wear of the operating element, whether these data be stored by the governing and control unit according to pre-determined tables as a function of the processing parameters, or whether these data be monitored directly during the processing itself.

On the basis of these data the governing and control unit alters the parameters of actuation of the operating element, according to the progressive wear of that element, by acting on the speed of rotation of the element, on the radial and/or lateral displacement of its supporting arm and possibly also on the inclination of its axis, so as to keep the honing action constant and uniform as the processing proceeds.

According to a variant at least one second feeler unit is included upstream of the first processing assembly of the honing machine according to the invention.

This second feeler unit is specifically suitable to monitor projections and valleys along the profile of the piece to be honed and also the radius of curvature thereof and conditions therefor the speed of rotation of the operating element and/or the pressure thereof against the piece and/or possibly also the speed of feed of the piece to be honed, thus conditioning the strength of the honing action of the operating element on the piece according to such monitoring.

This second feeler unit may be one alone and may govern all the processing assemblies of the honing machine according to the invention.

According to a variant each processing assembly comprises both the profile-reader assembly and the second feeler unit.

According to a further variant the second feeler unit also acts as a profile-reader unit.

The inclusion of the second feeler unit makes it possible to obtain compensation of the specific interval of time, during which the operating element acts on a specific segment of the profile of the piece to be honed, according to the geometric and structural characteristics of the profile of the piece to be honed.

The inclusion of projections and valleys, in fact, causes a greater and shorter stay time respectively of the operating element in contact with a given segment of the profile of the piece.

The longer the stay time of the operating element at a projection, such stay time being proportionately as much longer as the radius of curvature is smaller, will determine too intense an action of the operating element, so much so that, where there are pointed prominences or rounded protrusions with a small radius of curvature, the removal of such prominences may take place.

Viceversa, the shorter stay time of the operating element at a valley may lead to too gentle a honing action.

According to another variant the governing and control unit comprises means to identify the presence of projections and valleys on the profile of the piece to be honed and also the radius of curvature thereof directly as a result of the monitoring performed by the profile-reader assembly.

According to yet another variant means are included to compensate the honing action of the operating element according to its approach to or distancing from the axis of rotation of the turntable, as determined by the conformation of the piece and/or by the presence of projections and valleys on the profile.

The approach to or distancing from the axis of rotation causes, in fact, a variation of the peripheral speed of the piece, which has to be compensated by taking action on the speed of rotation and/or on the pressure of the operating element according to the identification of that distance.

The attached figures are given as a non-restrictive example and show some preferred embodiments of the invention as follows:

FIG. 2 shows a working diagram of the second feeler unit according to the invention;

FIG. 3 is a diagram of the honing machine with displacement of the piece by a turntable;

FIG. 4 shows the honing machine with linear displacement of the piece;

Figure 9:
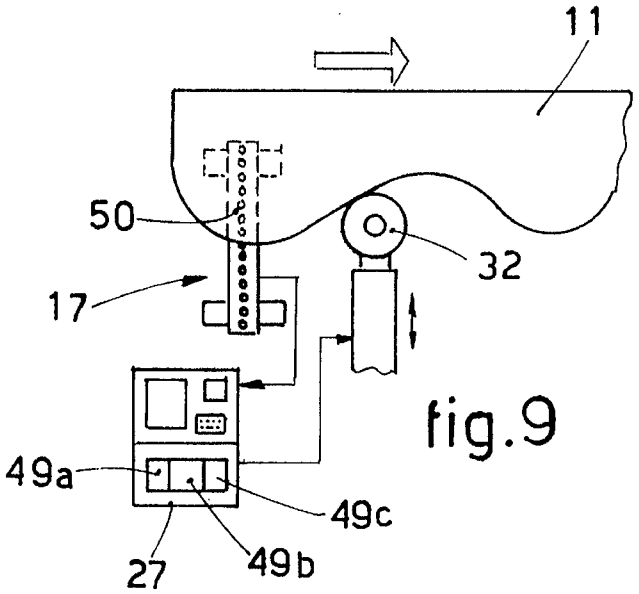
Figure 10:
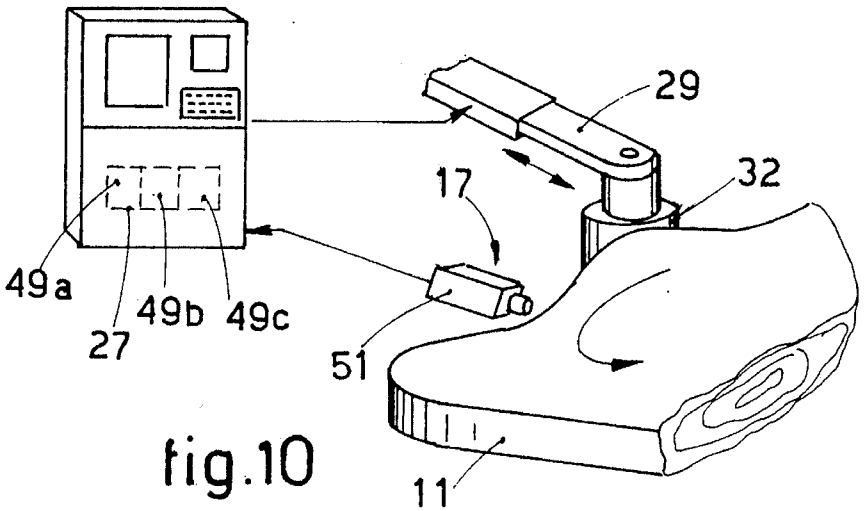
Figure 8:
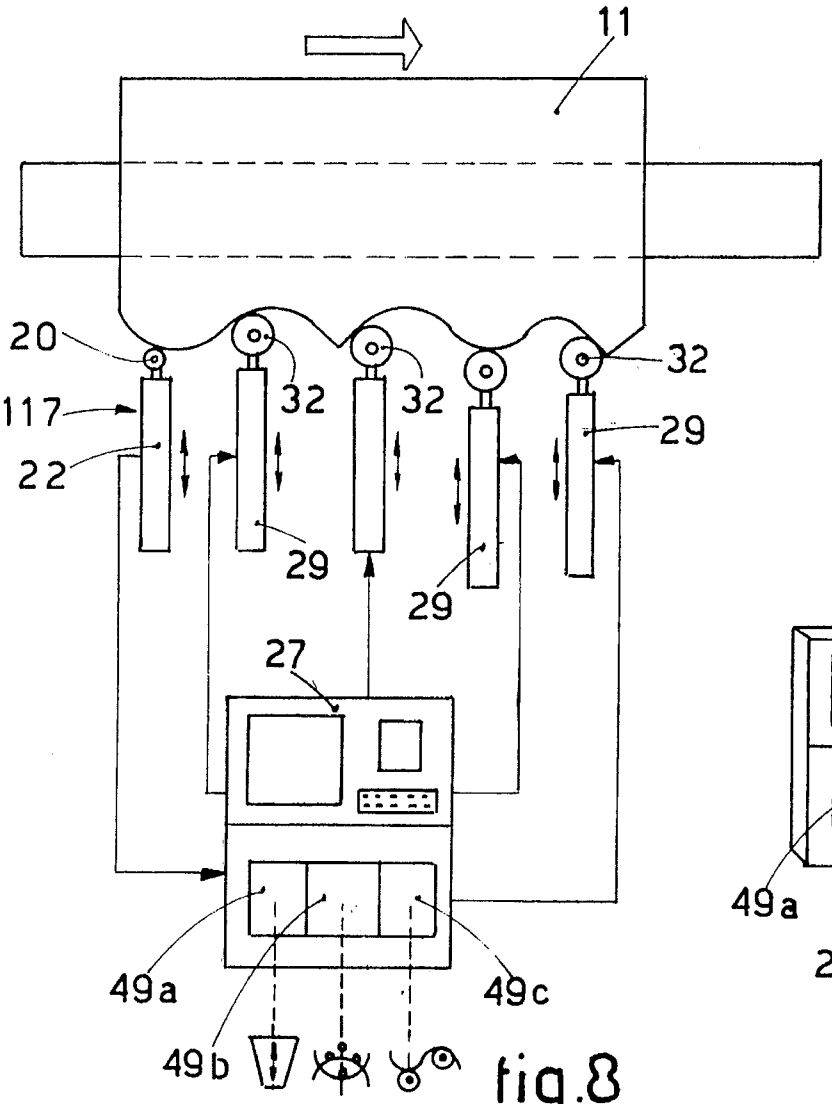

FIGS. 5*a* 5*b* and 5*c* show the process of compensation of wear of the operating element;

FIG. 6 shows a variant which includes the first and second feeler units incorporated in one single feeler unit;

FIGS. 7*a* and 7*b* show two working steps of the feeler unit of FIG. 6;

FIG. 8 is a diagram of a variant of FIG. 4;

FIGS. 9 and 10 show possible examples of the embodiments of units for optical reading of the profile.

Figure 1:
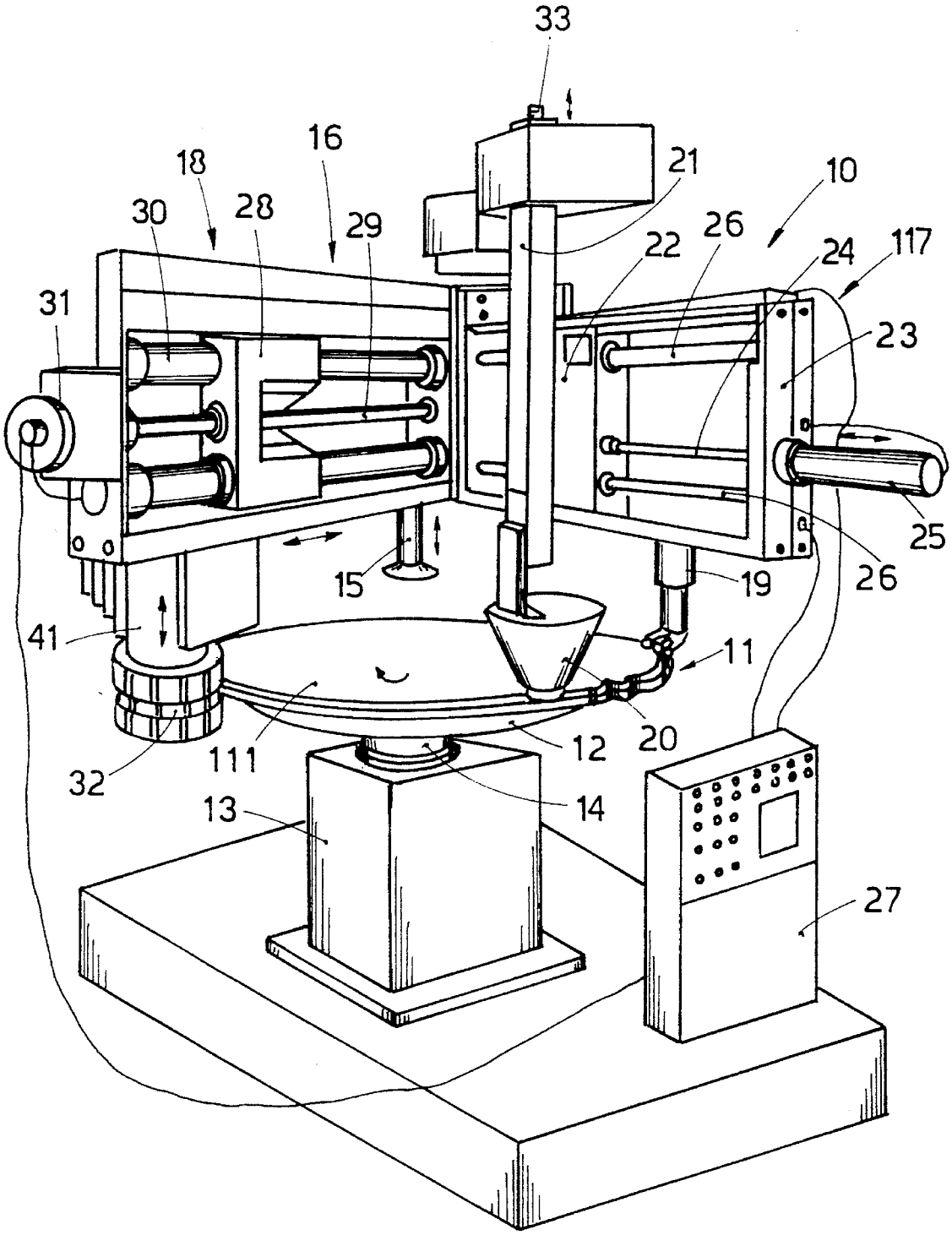
FIG. 1 is a three-dimensional view of a form of embodiment of a honing machine for curved and shaped profiles according to the invention.

FIG. 1 shows a possible form of embodiment of a machine 10 to hone curved or shaped profiles according to the invention, the machine being of a type in which a piece 11 to be honed is rotated on a turntable and the machine provides reading of a mechanical type of the profile of the piece 11.

The piece 11 to be honed in this case consists of a surface of a table 111 and is positioned on a turntable 12 fitted to a base 13 and cooperating at its lower side with drive means 14.

During processing, when the surface of the table 111 has been positioned on the turntable 12, a thrust element 15 is lowered onto the surface of the table 111 and keeps it rigidly in position.

According to a variant which is not shown here, the turntable 12 includes in its lower portion aspiration means, which create a negative pressure against the piece 11 to be honed and retain the same on the turntable 12 during the whole processing.

A plurality of processing assemblies 16 cooperate with the periphery of the surface of the table 111.

For the sake of convenience of illustration FIG. 1 shows only one of the processing assemblies 16, but a plurality of substantially equal processing assemblies 16 may be included and be arranged at a distance apart in cooperation with the periphery of the piece 11 to be honed.

In the embodiment of FIG. 1 each processing assembly 16 consists of a reader assembly to read the profile, the assembly in this case consisting of a first feeler unit 117 and an operating unit 18; the first feeler unit 117 is located upstream of the relative operating unit 18 according to the direction of rotation or feed of the piece 11 to be honed.

The first feeler unit 117 and operating unit 18 are arranged radially in relation to the piece 11 to be honed when that piece 11 is rotated on a turntable (FIG. 3), and perpendicularly to the axis of feed of the piece 11 where that piece 11 is moved in a linear manner (FIG. 4).

A second feeler unit 19, the function of which will be explained hereinafter, is included upstream of the first processing assembly 16 in this case and is fitted to an independent supporting and actuation assembly, which is not shown in the figure.

The first feeler unit 117 comprises a feeler element 20 fitted to an arm 21 solidly associated with a first movable carriage 22, which is guided at its lower and upper ends within a frame 23 and can be moved radially in relation to the axis of rotation of the turntable 12 so as to take the feeler element 20 nearer to or farther from the surface of the table 111.

In this case the first movable carriage 22 is associated with drive means consisting of a piston rod 24 with a pneumatic cylinder 25 and slides on guides 26.

When processing begins, the surface of the table 111 is set in movement and the feeler element 20 is brought into contact with the profile of the table 111 to be processed by means of displacement of the first movable carriage 22.

The surface of the table 111 being rotated induces radial and/or lateral movements in the feeler element 20, thus enabling each position of the profile of the table 111 to be read and identified.

The data relating to that profile are sent to a governing and control unit 27 by means of an encoder associated with the first movable carriage 22.

The governing and control unit 27 processes the data received and transfers them to the operating unit 18 with a delay which is a function of the distance between the positions of the first feeler unit 117 and the operating unit 18 itself and is also a function of the relative speed of displacement of the piece 11 to be honed.

When one single feeler unit 117 is associated with two or more operating units 18, the governing and control unit 27 transfers the relative data of the profile of the piece 11 to be honed with differentiated delays which are a function of the individual distances between the positions of the relative operating units 18 and of the feeler unit 117 and are also a function of the speed of relative displacement of the piece 11 to be honed.

The operating unit 18 has a structure substantially analogous to that of the first feeler unit 117, comprises a second carriage 28 able to move radially in relation to the axis of rotation of the surface of the table 111, is associated with worm displacement means 29 and can slide on guides 30.

In this example the drive means of the second movable carriage 28 comprise a D. C. motor 31 provided with an actuation means.

An operating element 32 solidly associated with the second movable carriage 28 and fitted to an arm 41 cooperates with a motor equipped with an inverter and is capable of carrying out the required operation on the profile of the table surface 111.

The operating element 32 may consist, depending on the case in question, of an abrasive grinding wheel, an abrasive belt fitted to rollers, or an abrasive belt fitted to rollers and associated with a thrust pad or other analogous means.

The governing and control unit 27 controls the actuation of the operating unit 18 according to the data obtained by the feeler element 20 directly on the specific piece 11 to be honed immediately before the honing process.

According to the embodiment shown the feeler element 20 has a conformation suitable to provide mechanically an automatic compensation of the wear of the operating element 32 while processing is proceeding. Such wear entails a reduction of the diameter of the operating element 32, and this reduction, if not compensated, would lead to a weaker and weaker and uneven honing action on the whole profile of the piece 11.

In this example the feeler element 20 has the conformation of a truncated cone with its vertex facing downwards.

According to a variant which is not shown, the feeler element 20 has its vertex facing upwards.

As the processing and the wear of the operating element 32 proceed, the feeler element 20 is raised progressively by the lifting of its arm 22 associated with a screw-threaded means 33 so as to reduce the dimension of the surface of contact between the feeler element 20 and the profile of the piece 11 to be honed.

In this way the data obtained regarding the profile are changed according to the wear of the operating element 32 and according to the reduction of diameter thereof.

FIGS. 5*a*, 5*b* and 5*c* shows three distinct phases of the axial positioning of the feeler element 20 in relation to the piece 11 to be honed.

The compensation can be carried out continuously or at pre-set periodical intervals, the frequency and length of which can be pre-set on the basis of experimental data relating to the actual wear of the operating element 32.

The truncated-cone conformation of the feeler element 20 with its vertex facing downwards is shown merely as an example but other functionally analogous conformations can be employed provided that they make possible, by means of its displacement on a plane advantageously perpendicular to the plane of positioning of the piece 11 to be honed, a reduction of the diameter of the feeler element 20.

According to a variant the operating element 32 is associated with means that measure wear continuously or periodically, such means being connected to the governing and control unit 27 so as to alter, according to the wear measured, the diameter of the surface of contact between the feeler element 20 and the profile of the piece 11 to be honed.

According to a variant of the invention a second feeler unit 19 is included upstream of the first feeler unit 117 and has the task of identifying any projections 35 or valleys 34 in the profile of the piece 11 to be honed (FIG. 2).

According to a variant the second feeler unit 19 is also able to evaluate the radius of curvature of such projections 35 or valleys 34.

The inclusion of projections 35 and valleys 34 and their more or less accentuated curvatures entail changes in the stay time and in the pressure and dimension of contact of the operating element 32 with any specific segment of the profile of the piece 11 to be honed, the nature of such contact not being punctiform.

Such changes take place in relation to changes in the radii of curvature of the segments of profile affected by the honing action according to the presence of projections 35 and valleys 34, thereby entailing a variation in intensity of the honing action.

To be more exact, a shorter stay time, per unit of linear space, of the operating element 32 at the valleys 34, such time being proportionately as much shorter as the curvature is more accentuated, entails, given an equal speed of rotation of the operating element 32, a honing action which may be too gentle.

Viceversa, a longer stay time at the projections 35, being proportionately as much longer as the curvature is more accentuated, will entail a honing action which may be excessive.

The identification of projections 35 and valleys 34 and their radius of curvature may make possible a compensation of the speed of rotation and/or of the pressure of the operating element 32 in relation to the longer or shorter stay time of that element 32 in contact with a specific segment of the piece 11 to be honed.

A possible embodiment of the second feeler unit 19 is shown in FIG. 2.

The second feeler unit 19 consists of three contact elements 36*a* and 36*b*, each of which consists of a small ball, roller or slide block fitted to a small articulated carriage 37.

The small articulated carriages 37 are pivoted at 38 on a movable shaft 39, which can move, depending on the situation in question, radially or perpendicularly to the profile of the piece 11 to be honed.

The two outer contact elements 36*a* of the three contact elements of each feeler element 19 are fitted immovably to their articulated carriage 37, whereas the central contact element 36*b* is fitted to a further small carriage 40, which is secured to the central articulated carriage 37 and can move in a direction perpendicular to the line joining the centres of the two outer contact elements 36*a*.

The further small carriage 40 is associated with an encoder which evaluates the sign and extent of the displacements of the central contact element 36*b* in relation to the reference axis consisting of the line joining the centres of the two outer contact elements 36*a*.

The data obtained by the decoder has the purpose of compensating the speed of rotation and/or pressure of the operating element 32 as a function of the presence of projections 35 and valleys 34.

In other words, the speed of rotation and/or the pressure of the operating element 32 take on a determined reference value corresponding to the situation of a substantially straight segment of profile (position B of FIG. 2) at which the central contact element 36*b* is substantially on the same axis as the two outer contact elements 36*a*.

Where there is a valley 34 (position A of FIG. 2), the central contact element 36*b* protrudes outwards beyond the line joining the centres of the two outer contact elements 36*a* by a positive value 1'; the smaller the radius of curvature of the valley 34 is, the greater will be the value 1'.

This enables the governing and control unit 27 to identify the presence of the valley 34, to evaluate the radius of curvature of the same and to increase the speed of rotation and/or the pressure of the operating element 32 in proportion to the shorter time of contact between the operating element 32 and the profile of the piece 11 to be honed.

Where there is a projection 35 (position C of FIG. 2), the central contact element 36*b* is thrust inwards beyond that joining line by a negative value 1", which is a function of the radius of curvature of the projection 35.

In this case too the governing and control unit 27 can thus identify the presence of the projection 35 and can evaluate the radius of curvature thereof and will reduce proportionately the speed of rotation and/or the pressure of the operating element 32 to compensate the longer time of contact with the profile of the piece 11 to be honed.

The smaller the radius of curvature of the projection 35 is, that is to say, the greater the retraction of the central contact element 36*b* is, the greater the reduction of speed and/or pressure will be and may even reach the stoppage of the operating element 32.

Position D of FIG. 2 indicates a great retraction 1'" corresponding to the presence of a pointed peak 35*a*, which, where there is no compensation of the speed, could even be removed by the action of the operating element 32.

The embodiments of FIGS. 6, 7*a* and 7*b* show a third feeler unit 217 which incorporates the functions of the first 117 and second 19 feeler units and enables the installation of at least one movable shaft in the honing machine 10 to be dispensed with.

In this example the third feeler unit 217 comprises a truncated-cone feeler element 20 associated with at least two rollers 42. These rollers 42 are arranged with their axes parallel to, and advantageously have the same height as, the straight generating line of the feeler element 20.

The rollers 42 are associated with relative supporting rod means 44, which cooperate with the upper and lower faces (the lower face is not shown in the figure) of the feeler element 20 and are pivoted together substantially at the axis of rotation of the feeler element 20 and are resiliently constrained together by spring means 43.

Moreover, in this case the supporting rod means 44 are associated at their ends with sliders 45 associated with a rack 46.

Means are also included to limit the minimum 47 and maximum 48 travel of the sliders 45.

During movement of the piece 11 to be honed in contact with the feeler element 20, spring means 43 permit the rollers 42 to move at an angle towards or away from each other according to the type of the contact profile of the piece 11 to be honed.

In fact, the projections 35 and valleys 34 in the profile of the piece 11 to be honed cause displacements of the rollers 42; these displacements are resisted by the spring means 43 and consist respectively in a reciprocal approach of the rollers 42 (FIG. 7*a*) defined by a first angle (a') and in a reciprocal distancing of the rollers 42 (FIG. 7*b*) defined by a second angle (a").

These reciprocal displacements are also a function of the radii of curvature of the projection 35 and valleys 34.

By associating at least one of the sliders 45 with an encoder it is possible to obtain the extent of such approach or distancing, to identify the presence of projections 35 and valleys 34 in the profile and to send such information to the governing and control unit 27, which can thus take action to adjust the honing action of the operating element 32 according to the criteria cited earlier.

In this case the first processing assembly 16 can include the third feeler unit 217, whereas the other processing assemblies 16 located downstream will include the first feeler unit 117 as shown in FIG. 5*a* for instance.

According to a variant, where the operating element 32 processes the piece 11 to be honed with its lower surface, means may be included to adjust the height of the operating element 32 so as to compensate the progressive wear thereof during the processing.

According to another variant, where the piece 11 to be honed is moved on a turntable, means are included to compensate the speed of rotation of the operating element 32 in proportion to its approach towards or distancing from the axis of rotation of the turntable 12 where such approach or distancing are caused by the conformation of the piece 11 to be honed and/or by the presence of valleys 34 or projections 35 in the profile of the piece 11. In fact, such approach and distancing determine a variation in the peripheral speed of the piece 11, and this variation has to be compensated.

Such compensation means (not shown here) consist, for instance, of a position sensor fitted directly, for instance, to the second movable carriage 28 associated with the operating element 32.

This position sensor can evaluate the position of the second movable carriage 28 in relation to the axis of rotation of the turntable 12 and can act on the speed of rotation and/or pressure of the operating element 32 according to the identification of that distance.

According to another variant, where the operating element 32 consists of an abrasive belt fitted to rollers and cooperating, in the zone of contact, with a thrust pad which can rotate to suit itself to the profile of the piece 11 to be honed, the rotation of the thrust pad can be controlled and governed by the indications of the second feeler unit 19 of the type shown in FIG. 2.

To be more exact, the second feeler unit 19 is able to identify directly the variations of inclination along the profile of the piece 11 to be honed in terms of the radius of curvature by reading, moment by moment, the variation of inclination of the line joining the centres of the outer contact elements 36*a* in relation to the movable shaft 39.

The variant of FIG. 8 shows an embodiment which includes one single feeler unit 117 with a relative feeler element 20, which governs a plurality of operating elements 32.

In this example the feeler element 20 may have any conformation, cylindrical for instance, and the axial position of the feeler element 20 is advantageously kept stationary during the whole period of the processing.

According to the invention the governing and control unit 27, to which the feeler element 20 sends continuously the data relating to the profile of the piece 11 to be honed, comprises specific data processing means 49*a* able to act on the relative operating elements 32 so as to compensate the progressive wear thereof 32 by means of electronic data processing.

These data processing means 49*a* receive as input the wear parameters, whether the latter be pre-memorised or monitored continuously on the operating elements 32, and provide as output the correction parameters for actuation of the operating element 32 by acting, for instance on the relative displacement means 29 or on the speed of rotation or on the honing pressure applied by the operating element 32 itself.

According to another variant the governing and control unit 27 includes specific data processing means 49*b* able to detect, merely from the reading provided by the feeler element 20, the inclusion of projection 35 and valleys 34 on the profile of the piece 11 to be honed and to evaluate the relative radii of curvature thereof 34–35.

On the basis of these data the specific data processing means 49*b* provide as output, by means of electronic data processing, the correction parameters for actuation of the operating element 32 in terms of speed of rotation or honing pressure, for instance.

According to yet another variant the governing and control unit 27 includes specific data processing means 49*c* able to evaluate, merely from the reading of the profile monitored by the feeler element 20, the variation of the relative peripheral speed as between the piece 11 to be honed and the operating element 32.

According to this variation of peripheral speed and in a manner analogous to that detailed above, the data processing means 49*c* condition, by means of electronic data processing, the actuation of the operating element 32 so as to ensure a constant and uniform honing action along the whole profile of the piece 11 to be honed.

According to the further variants shown in FIGS. 9 and 10 the profile-reader assembly 17 is of an optical type. In the example of FIG. 9 this profile-reader assembly 17 consists of an ordered series 50 of optical sensors of a photoelectric cell type or of a laser type.

These optical sensors send out beams of light, which are intercepted by the profile of the piece 11 to be honed, this piece being set in relative movement, thus making possible the identification and reading of all the positions of that profile.

In the example of FIG. 10 the profile of the piece 11 to be honed is read continuously by a telecamera 51.

The profile-reader assembly 17 of an optical type sends the data of the profile of the piece 11 to be honed to the governing and control unit 27, which conditions the actuation of the operating element 32.

In this case too the governing and control unit 27, according to possible evolutive variants, may include the specific data processing means 49*a*–49*b* and 49*c* so as to condition the actuation of the operating element 32 respectively according to the progressive wear of the same 32, according to the presence and conformation of projections 35 and valleys 34 along the profile or according to the variations of the relative peripheral speed as between the piece 11 to be honed and the operating element 32.

A profile reader assembly used in the honing machine of the invention can be used to govern one or a plurality of operating units 18.

I claim:

1. A method of honing profiles of furniture components, wherein a profile is at least partly curved or shaped, comprising (1) continuously identifying and reading each geometric configuration of a profile of a furniture component to be honed by means of a profile reader assembly including a feeler unit which identifies a radius of curvature of the geometric configuration of each curve or shape present in the profile prior to said curve or shape being honed; (2) storing data on each geometric configuration obtained in (1); (3) transferring said data to an operating unit equipped with an operating element that performs honing and thereby positioning the operating unit in relation to said furniture component to be honed, wherein said transferring of said data occurs following a delay in said identifying and reading of the geometric configuration in (1), the delay being a function of circumferentially positioning the operating unit in relation to the profile reader assembly and a function of the relative speed of feed of the furniture component to the operating element; and (4) automatically compensating for speed of rotation and/or pressure of the operating element in relation to stay time of the operating element in contact with the furniture component to be honed based on the identification of the radius of curvature of the geometric configuration of the profile of the furniture component, wear of the operating element and honing to be performed, and wherein the stay time is variable depending on the geometric configuration identified.

2. A method according to claim 1 wherein said feeler unit conducts said reading of (1) mechanically by means of a feeler element present in said feeler unit.

3. A method according to claim 1 wherein said feeler unit conducts said identifying and reading of (1) optically by means of an optical identification and reader means.

4. A method according to claim 1 wherein said wear of the operating element in (4) is based on data containing experimental values of wear for the operating element.

5. A method according to claim 1 wherein the wear of the operating element in (4) is based on performing continuous dimensional monitoring of the operating element.

6. A method according to claim 2 wherein said automatically compensating of (4) is based on variations in diameter of contact surface between the feeler element and the profile of the furniture component.

7. Method according to claim 1 wherein the automatically compensating of (4) is based on variations in relative peripheral speed between the furniture component and the operating element.

8. Apparatus for honing profiles of furniture components wherein a profile is at least partly curved or shaped comprising displacement means for displacing a furniture component to be honed wherein the displacement means moves a profile of the furniture component into cooperation with at least one processing assembly of the apparatus, wherein each processing assembly comprises at least one profile reader assembly which includes a feeler unit which reads the profile of the furniture component by identifying a radius of curvature of a geometric configuration of a curve or shape present in the profile prior to said curve or shape being honed and at least one operating unit including an operating element positionable in at least one inactive position distanced from said furniture component and in at least one working position in contact with the profile of the furniture component when the furniture component is moving, and wherein said at least one profile reader assembly is positioned in a predetermined spatial relationship with the operating unit; a governing and control unit operatively associated with said operating unit and said at least one profile reader assembly; and an automatic compensating means which compensates for speed of rotation and/or pressure of the operating element in relation to stay time of the operating element in contact with the furniture component to be honed while conforming positioning of the operating element to the profile of the furniture component, and wherein the stay time is variable depending on the geometric configuration identified.

9. Apparatus for honing according to claim 8 wherein a profile reader assembly is present in relation to each operating unit present.

10. Apparatus for honing according to claim 8 wherein said at least one processing assembly controls a plurality of operating units.

11. Apparatus for honing according to either of claim 8, 9 or 10 wherein the automatic compensating means is governed by data which includes experimental data based on wear of the operating element.

12. Apparatus for honing according to either of claim 8, 9 or 10 wherein the automatic compensating means is governed by a monitoring means which continuously monitors dimensional characteristics of the operating element.

13. Apparatus for honing according to claim 8 wherein the automatic compensating means is governed by data processing means present in the governing and control unit and which is operatively associated with the at least one profile reader assembly.

14. Apparatus for honing according to claim 8 wherein said feeler unit includes a feeler element.

15. Apparatus for honing according to claim 14 wherein the feeler element is essentially cone-shaped or truncated cone-shaped and cooperates with a diameter varying means which varies diameter of contact surface with the furniture component to be honed, wherein the diameter varying means is governed by said automatic compensating means.

16. Apparatus for honing according to claim 14 wherein said displacement means is of a turntable-type, and the feeler element and operating element move in directions substantially radial to an axis of rotation of the furniture component.

17. Apparatus for honing according to claim 14 wherein the displacement means displaces the furniture component linearly, and the feeler element and the operating element each move in a direction substantially perpendicular to an axis of feed of the furniture component.

18. Apparatus for honing according to claim 8 wherein said feeler unit includes an optical sensor reading means or telecamera reading means.

19. Apparatus for honing according to claim 8 wherein the operating element is an abrasive grinding wheel.

20. Apparatus for honing according to claim 8 wherein the operating element is an abrasive belt fitted to rollers.

21. Apparatus for honing according to claim 8 wherein the operating element is an abrasive belt fitted to rollers and present cooperatively in a vicinity of contact of a thrust pad.

22. Apparatus for honing according to claim 8 wherein said automatic compensating means is controlled by data processing means included in the governing and control unit and is operatively associated with the at least one profile reader assembly, wherein the data processing means identifies the presence of a curve or shape in a profile of the furniture component and evaluates the radius of curvature of the curve or shape and based thereon reduces or increases respectively speed of rotation or pressure of the operating element against the furniture component.

23. Apparatus for honing according to claim 8 wherein a second feeler unit is present and is positioned at least upstream of an operating unit of a first processing assembly of said at least one processing assembly.

24. Apparatus for honing according to claim 23 in which the feeler unit and the second feeler unit are separate elements.

25. Apparatus for honing according to claim 23 wherein the feeler unit and the second feeler unit are present as a single feeler unit.

26. Apparatus for honing according to claim 8 wherein a data processing means is included in the governing and control unit and is operatively associated with the at least one profile reader assembly, said data processing means being structured to identify variations in relative peripheral speed of the furniture component in relation to the operating element.

27. Apparatus for honing according to claim 26 wherein the data processing means controls the automatic compensating means.

* * * * *